United States Patent [19]

Reeder

[11] 4,403,641

[45] Sep. 13, 1983

[54] ADJUSTABLE, QUICK INSTALLATION, WINDOW COVERING DEVICE

[76] Inventor: William M. Reeder, 2666 St. Rte. 82, Aurora, Ohio 44202

[21] Appl. No.: 296,430

[22] Filed: Aug. 26, 1981

[51] Int. Cl.[3] ..... A47G 5/02

[52] U.S. Cl. ..... 160/263; 160/238; 248/267

[58] Field of Search ..... 160/263, 245, 250, 239, 160/240, 238; 248/266–268

[56] References Cited

U.S. PATENT DOCUMENTS

| | | | |
|---|---|---|---|
| 92,012 | 6/1869 | Burgess | 160/263 X |
| 1,576,832 | 3/1926 | Larsen | 248/267 |
| 1,772,621 | 8/1930 | Wofford et al. | 248/266 |
| 3,202,206 | 8/1965 | Boulanger | 160/263 |
| 3,878,878 | 4/1975 | Reeder | 160/246 |
| 4,102,383 | 7/1978 | Miller | 160/263 |
| 4,157,108 | 6/1979 | Donofrio | 160/263 |

*Primary Examiner*—John E. Mirtagh
*Assistant Examiner*—Cherney S. Lieberman
*Attorney, Agent, or Firm*—John W. Huckert

[57] ABSTRACT

A window covering device for use with framed windows of varying sizes includes an elongated support rod having a slot therein for receiving an end of a piece of shade material, a support bracket being provided for each end of the elongated support rod, structure associated with one end of the elongated support rod to permit easy length adjustment thereof for sizing to various sized window frames, and additional structure in the form of a projection from each support bracket for permitting quick installation and securement of the support brackets to a window frame by means of U-shaped staples of sufficient size to fit over the projections.

5 Claims, 5 Drawing Figures

ADJUSTABLE, QUICK INSTALLATION, WINDOW COVERING DEVICE

BACKGROUND OF THE INVENTION

1. Field of the Invention

This invention relates generally to a window covering device preferably a window shade having provision for sizing the width of said device to conform to a window frame with which it is desired to be installed, and additional structure for permitting quick and easy installation thereof.

2. Description of the Prior Art

A common problem with known window shade type covering devices is that they must be specifically precut for a particular window frame width prior to installation thereof. This of course makes it necessary that a large number of various sized window covering units be kept in stock to fit the many widths of windows currently in the field.

Another common problem with known type window shade devices is that oftentimes the individual homeowner will inaccurately measure the window frames with which the covering device is to be used, and therefore will order and buy the wrong size covering device. Then, the mistake is discovered during installation, which obviously causes many problems.

Another problem of known type adjustable window covering devices is that they are relatively complicated and difficult to properly size. Then, even after being properly sized, installation thereof can be troublesome and time consuming.

The inventor of the present invention has a prior U.S. Pat. No. 3,878,878, entitled Window Accessories, which was granted on Apr. 22, 1975. The window covering device of the present invention is an improvement over this earlier patent.

SUMMARY OF THE INVENTION

An object of the present invention is to provide a window device which is adjustable for various sizes of window frames and which after proper sizing thereof can be quickly and easily installed with the window frame.

Another object of this invention is to provide a window shade support mechanism having an elongated rod with a slot therein for receiving the end of a piece of window material with each end of the rod being supported by suitable support brackets each having an extending projection thereon for installation to a window frame by the use of U-shaped staples.

A further object of this invention is to provide a window covering device which permits quick and easy installation thereof by the use of staples rather than conventional type bracket structures.

A still further object of this invention is to provide a window shade device having an outer cylindrical cover for protection of the shade with both the outer covering as well as the central support rod for the shade being easily sized to fit various sizes of window frames.

One of the important features of the present invention is in the structure provided for permitting quick and easy sizing of the shade support roller as well as the outer cylindrical cover therefore to permit the use with window frames of various sizes. This proper sizing may be easily accomplished by a user of the device because of preinscribed indicia and score lines in both the shade rod as well as the outer covering sleeve.

Also support brackets are provided which have a central bearing support structure therein for reception of the opposite ends of the shade rod to permit the usual drawing and redrawing of the window shade as desired over the glass portion of the window. A projection provided on each bracket permits quick and easy installation to a window frame by the use of U-shaped staples of sufficient size to fit over the projections. This feature permits quick and simple installation of the overall device once the proper sizing thereof has been made by an installer.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT(S)

Figure 1:
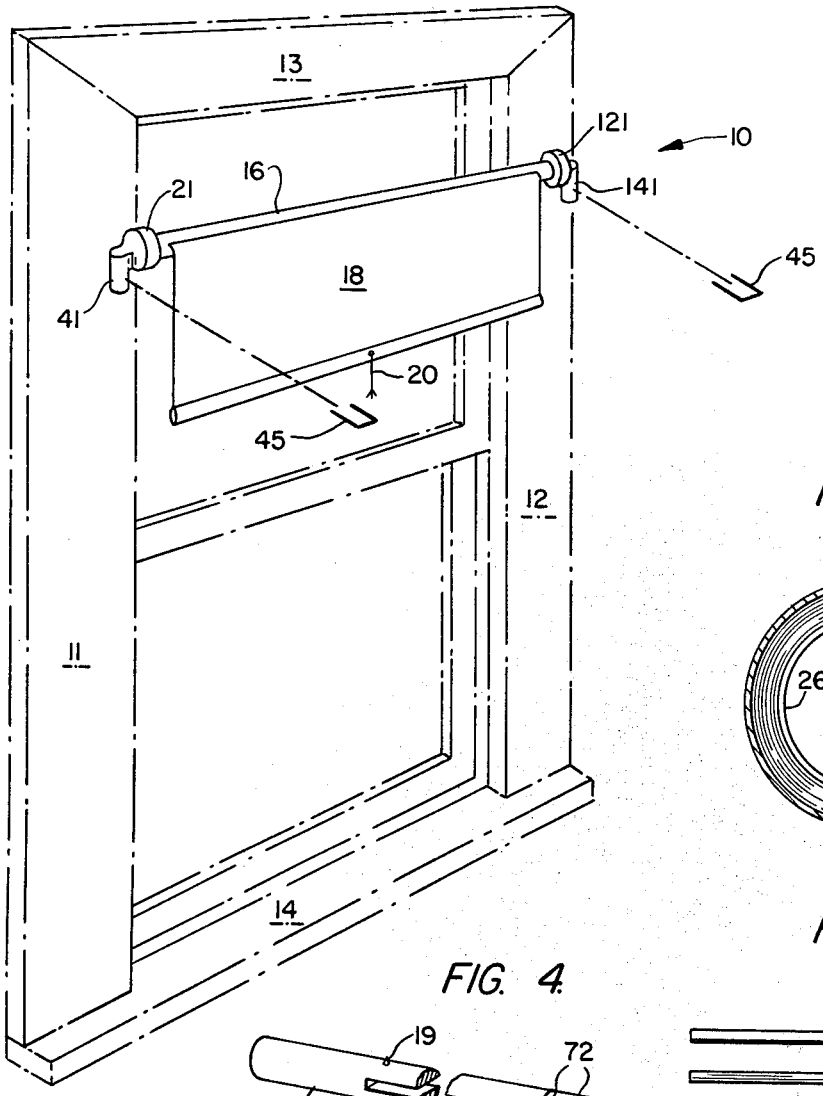
FIG. 1 is a perspective view of a window and frame with a window covering device as properly sized ready for installation.

Referring to FIG. 1 of the drawings, reference numeral 10 indicates in general the window covering device of the present invention after proper sizing thereof and ready for quick and easy installation to the encasing frame of the window unit. The encased window is shown in the figure as side frames 11 and 12 which extend in the vertical direction, a top horizontal frame 13, and a bottom window sill 14.

Figure 2:
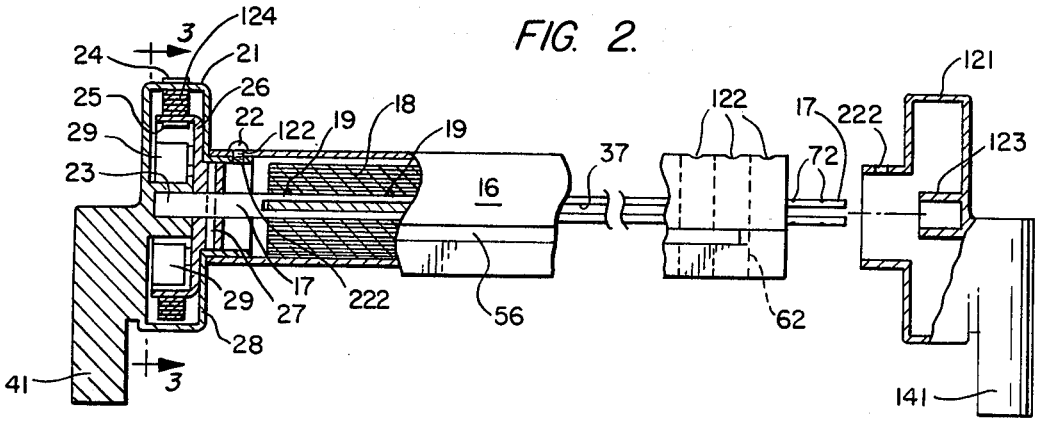
FIG. 2 is an elevational view, partly in cross-section, showing the window shade rod, the outer covering cylinder, and the support bracket at each end thereof.

The window covering device of the present invention is best seen in FIG. 2. An outer cylindrical cover or casing 16 having an elongated slot 56 therein encloses an elongated support rod 17. The central support rod 17 has a slot 37 therein for receiving one end of a piece of shade cloth 18. A series of spaced prongs 19 extending from the central rod engaged with and secure the inner end of the shade cloth 18. Preferably this shade cloth extends through the longitudinal slot 56 in the cylindrical outer casing 16 and is provided with a shade pull 20 at the unsecured end thereof. Support auxiliary casing end brackets 21 and 121 enclose the appropriate tension spring mechanism for the purpose of effecting rotation of the shade support rod 17 when desired after installation. This structure is similar to that disclosed in applicant's prior U.S. Pat. No. 3,878,878 referenced above. For this purpose, each of the auxiliary end brackets casing 21 and 121 is secured to the shade cylindrical covering casing 16 by a series of spaced screws 22. The respective ends of the central support rod 17 contained within the cover casing 16 are mounted in the central bearings 23 and 123 of the respective auxiliary end brackets casing 21 and 121.

Figure 3:
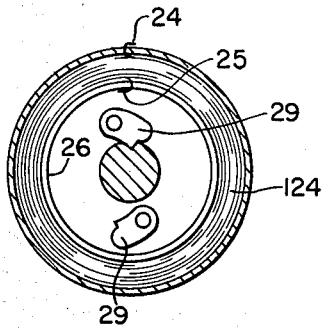
FIG. 3 is a cross-sectional view taken generally along lines 3—3 of FIG. 2.

FIG. 3 shows in more detail, the outer end portion 24 of the torsion spring 124 which is used to effect the desired rotation of the shade rod. The unit end portion 25 of the spring is connected to a cup 26 arranged in each auxillary casing end brackets and which in turn has a flat or pin key 27 extending to at least one end of the rod 17.

To enable the torsion spring and cup 26 to be assembled in the auxillary casing end brackets, the unit side wall 28 of the auxillary casing end brackets may be formed separately from the circumferential portion and secured thereto by welding, after the torsion spring and cup are assembled in place, or after the torsion spring and cup have been introduced into the auxillary casing end brackets, the portion 28 may be bent inwardly with its circular end portion terminating within the casing end brackets 16 to which it may be secured by the screws 22. Of course the pin 27 extending through an appropriate opening in the end of rod 17 effects rotation of the rod by means of the torsion spring 124.

Since it is desired to have one end of the device adjustable, the torsion spring mechanism is preferably omitted from the casing end brackets 121 so that the only function this casing 121 plays is to support the right hand end of rod 17, as viewed in FIG. 2 within the bearing 123. Also the right end of the outer casing 16, once properly sized is also supported by this casing end bracket 121. As shown in FIG. 2, the right hand end of the outer casing 16 is preferably provided with preinscribed and/or scored lines 62 together with a plurality of holes 122 for reception of an appropriate screw 22 therethrough after proper sizing of the right hand end of the casing 16. Of course, an aperture 22 is appropriately formed in the cylindrical neck of casing 121 for reception of a screw 22 therethrough.

Figure 4:
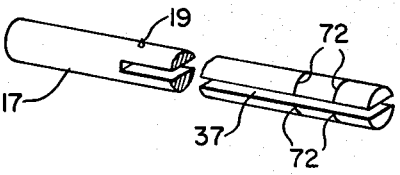
FIG. 4 is an enlarged fragmentary portion showing the center shade support rod per se.

Looking at FIG. 4, the preinscribed and/or scored right hand tip end of the rod 17 can be seen in greater detail. The scoring 72 permits an appropriate portion of each tip to be easily broken off during the initial sizing prior to actual installation of the device.

Another important feature of the present invention is in the provision of the extending projections, 41, 141 from the support casing end brackets 21 and 121, respectively. These extending projections 41 and 141 are used to quickly and effectively attach and secure the casing end brackets to the window frame uprights 11 and 12 of FIG. 1, after the initial sizing has been effected. Suitable large sized staples 45 of just slightly larger inner width between the tips thereof than the projections 41, 141 are used. As best seen in FIG. 1, these staples can be very quickly and effectively hammered into place to complete quickly and easily the installation of the window covering device of the present invention.

FIG. 3 shows the pair of pawls pivotally mounted on the inside of at least one cup 26 for engagement with the annular shaped recess in each outer surface of the bearing support portion 23, 123. Of course, when the window covering shade is pulled outwardly from the device, upon slow release thereof, one or the other pawl will tend to engage with the annularly shaped recess to lock the shade in desired partially covering position. However, when the shade is released rapidly the pawls will be thrown outwardly by centrifugal force and will permit complete rewinding of the shade 18 upon the support rod 17 by means of the tension of the spring 124.

Figure 5:
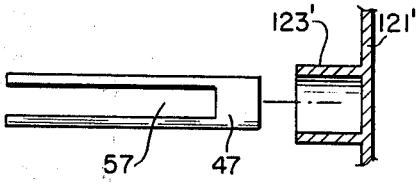
FIG. 5 is a modified embodiment of the window shade support rod and alternative support bracket structure.

Looking at FIG. 5 of the drawings, a modified embodiment of the right hand casing end bracket 121, as indicated by 121', is shown. This modified casing end bracket 121' has an enlarged central bearing 123' therein. The purpose of the enlarged bearing 123' is to receive an adjustable and slidable central rod unit 47. This unit 47 has a corresponding slot 57 provided over substantially all its length and of slightly/larger internal diameter than that of the outer diameter of the main shade support rod 17. Thus, by using this second rod portion, the original shortening of the main support rod 17 by means of the scored lines 72 can be replaced by the adjustable slidable secondary unit 47 which will permit infinite adjustments in just millimeters. While having this secondary support rod structure increases the number of elements of the present invention, it does offer the added feature of very fine sizing adjustment, and also eliminates any breaking or bending of the primary shade support rod 17. Similarly, rather than having the outer casing 16 shortened by means of the removable end portions at score lines 62, another slightly larger cylindrical unit, similar to that of the aforedescribed support rod secondary unit, can also be used for the outer casing. However, since this outer casing structure can be easily visualized from what has already been described, this outer casing is not specifically shown in the drawings.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A window covering device, for use with framed windows of varying size comprising:

an elongated support rod having a slot therein for receiving an end of a piece of shade material;

a bracket for each end of said elongated support rod;

means to permit easy length adjustment of an end of said support rod;

further means for quickly attaching each bracket to a window frame for a quick, simple installation of the device with a framed window;

each bracket having a rod end support bearing therein to permit rotation of said support rod and a mounting projection extending outwardly therefrom for association with said further means;

said further means for quickly attaching each bracket to a window frame consisting of a U-shaped staple of a sufficient size to fit over said bracket mounting projection;

said means to permit length adjustment of an end of said support rod including a plurality of circumferentially spaced grooves evenly spaced from the tip end of the slotted rod to permit portions thereof to be easily removed by breaking off during the initial sizing of the device; and the bracket associated with the said tip end of the slotted support rod is provided with an enlarged bearing opening, and a secondary support rod portion of larger diameter along its entire length than the slotted support rod is mounted upon the tip end of the slotted support rod and supported rotatably within the enlarged bearing of said bracket.

2. The device of claim 1, together with a cylindrical cover for the elongated support rod, said cover being provided with an extended slot to permit a piece of shade material as received by the slot of the elongated support rod to pass therethrough.

3. The device of claim 1 wherein at least one of said support brackets includes spring means for effecting rotation of said elongated support rod when desired.

4. The device of claim 1 wherein the cylindrical cover for the elongated support rod is provided with circumferential prescored indicia for permitting size adjustment thereof corresponding to the aforesaid size adjustment of the slotted support rod.

5. The device of claim 1 wherein a piece of shade material having pre-inscribed tearing indicia along at least one edge thereof is provided in combination with the support rod.

* * * * *